US005356201A

United States Patent [19]

Olson

[11] Patent Number: 5,356,201

[45] Date of Patent: Oct. 18, 1994

[54] CANOE BACKREST

[76] Inventor: Jerome Olson, 8424 Westwood Ave., Brooklyn Park, Minn. 55444

[21] Appl. No.: 920,263

[22] Filed: Jul. 27, 1992

[51] Int. Cl.[5] ..... A47C 15/00

[52] U.S. Cl. ..... 297/352; 297/410

[58] Field of Search ..... 297/352, 230, 397, 399, 297/400, 401, 402, 410, 452.53, 230.11

[56] References Cited

U.S. PATENT DOCUMENTS

| | | | |
|---|---|---|---|
| D. 201,961 | 8/1965 | Lohn | 297/410 X |
| 518,097 | 4/1894 | Derby | 297/352 |
| 1,366,506 | 1/1921 | Shattuck | 297/352 |
| 1,592,881 | 7/1926 | Albert et al. | 297/352 |
| 2,490,297 | 12/1949 | Gardner | 297/352 X |
| 2,508,769 | 5/1950 | Osbon et al. | 297/352 X |
| 2,612,938 | 10/1952 | Dawkins et al. | 297/352 |
| 2,663,359 | 12/1953 | Wood | 297/452.53 X |
| 2,666,474 | 1/1954 | Bossert et al. | 297/352 X |
| 2,707,513 | 5/1955 | Lake | 297/352 |
| 2,738,169 | 3/1956 | Highley | 297/352 X |
| 2,754,891 | 7/1956 | Barron | 297/352 |
| 3,337,268 | 8/1967 | Belk | 297/400 |
| 3,507,538 | 4/1970 | Stoller | 297/410 |
| 3,862,456 | 1/1975 | Fisher et al. | 9/7 |
| 3,990,743 | 11/1976 | Nelson | 297/352 |
| 4,045,834 | 9/1977 | Mason | 297/352 |
| 4,493,285 | 1/1985 | Williams | 114/363 |
| 4,869,551 | 9/1989 | Lathers | 297/443 |

FOREIGN PATENT DOCUMENTS

| | | | |
|---|---|---|---|
| 0186642 | 6/1907 | Fed. Rep. of Germany | 297/352 |
| 2735584 | 2/1979 | Fed. Rep. of Germany | 297/353 |

*Primary Examiner*—Peter R. Brown
*Assistant Examiner*—Milton Nelson, Jr.
*Attorney, Agent, or Firm*—Westman, Champlin & Kelly

[57] ABSTRACT

An adjustable backrest and frame for a canoe or boat seat lacking a built-in backrest or back support. The backrest and frame includes an automobile or truck headrest which is inserted into two corresponding brackets that are fastened to the canoe or boat seat. The bracket more particularly includes an attachment brace with an arm that connects it to a support tube. This support tube is where the elongate supports of the backrest telescope allowing for adjustment of the canoe or boat seat backrest and frame.

4 Claims, 3 Drawing Sheets

CANOE BACKREST

BACKGROUND OF THE INVENTION

The present invention relates to bench-seat backrests, and, more particularly, to adjustable canoe or boat seat backrests adapted for supporting a human back when a human is seated in a canoe or boat seat.

Many boats, and, more particularly, all canoes, have built-in seats typically lacking any kind of backrest. A human when either seated, rowing or paddling for a period of time may develop soreness or stiffness in the lower back due to a lack of support of the back over this period. Numerous devices have been developed as supports or backrests which attach or fasten to the canoe or boat seat. The goal which canoers and boaters are still in search of consists of an easily attachable backrest which is adjustable vertically and which properly supports the back so as to avoid or prolong the outset of backache or fatigue.

SUMMARY OF THE INVENTION

The present invention provides an adjustable canoe or boat seat backrest and frame using an automobile headrest as a backrest and two brackets for attachment of the backrest to a seat. Each bracket is comprised of a support tube, an arm, and a brace which is fastened to a canoe or boat seat by using a fastener, more particularly, a bolt. The support tubes are hollow cylinders adapted for the insertion of elongated supports which are attached to and extend from the bottom of the backrest.

The installation and operation of this adjustable canoe or boat seat backrest requires two holes near the rear edge of the seat into which the brackets will be fastened. These two holes may either exist from the factory on a new canoe or be drilled in a seat on a canoe already in use. Once the brackets are fastened in the holes then one support tube is inserted into each of the elongate supports on the bracket. These elongate supports are adjustable or telescoping within the support tubes. Once the backrest is properly positioned within the support tubes, a set screw on each support tube can be tightened and thereby fixing the position of the backrest.

DETAILED DESCRIPTION OF THE PREFERRED EMBODIMENTS

Figure 1:
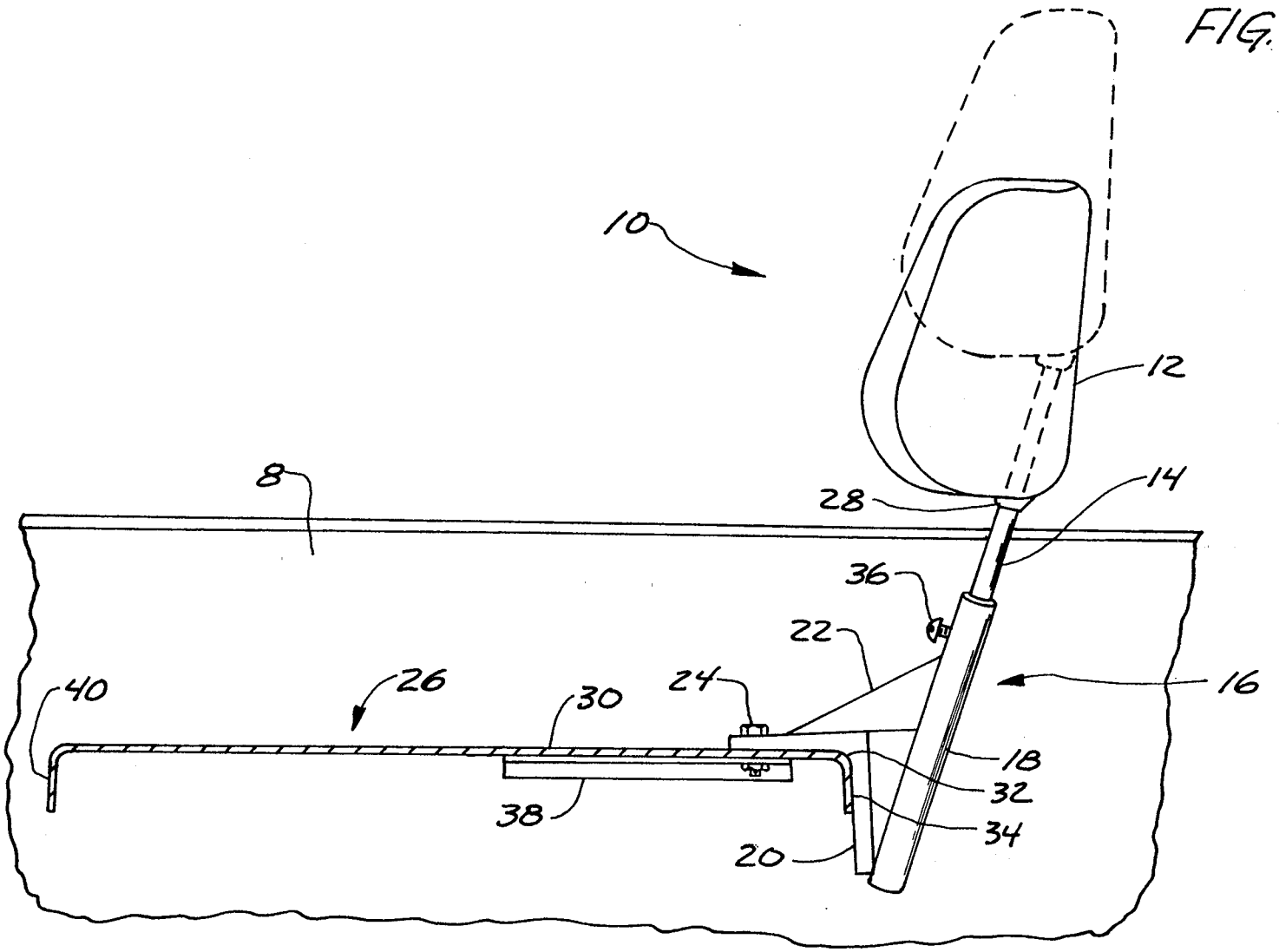
FIG. 1 is a side view of the present invention.

Having reference to the drawings, wherein like reference characters designate identical or corresponding parts throughout the different views, one embodiment of a backrest and frame for a canoe or boat 8 is shown in FIG. 1, and designated generally at 10.

Figure 2:
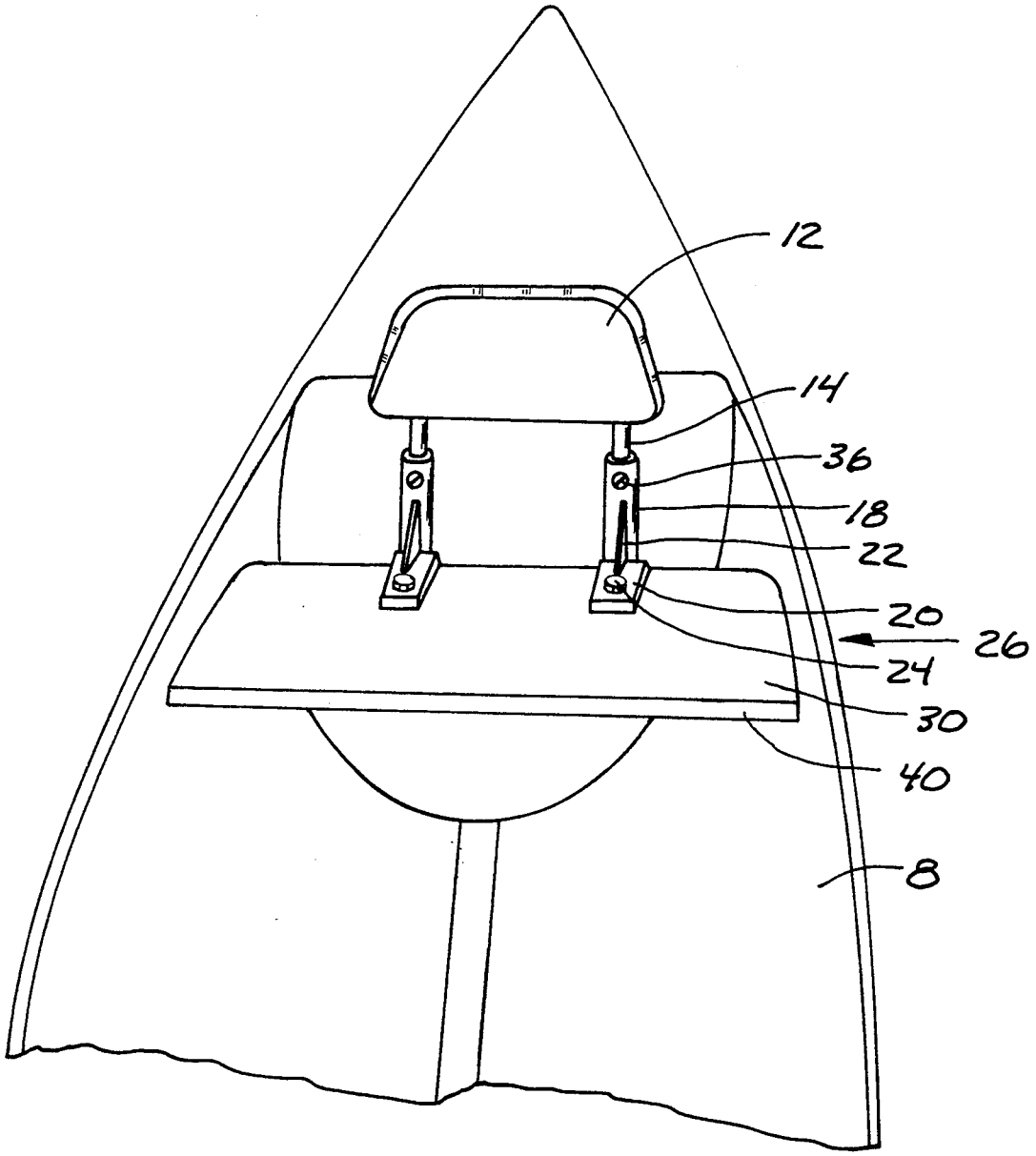
FIG. 2 is a front view of FIG. 1.

The backrest and frame includes a backrest 12 with two protruding elongate supports 14, which are round rods, and two brackets 16 (shown in FIG. 2). Each bracket 16 comprises a support tube 18, an L-shaped brace 20, a triangular arm 22, and a fastener 24 for attaching the bracket 16 to the canoe or boat seat 26.

The backrest 12 is an automobile or truck headrest with supports 14 that protrude from a base 28 of the headrest. The backrest 12 may be a stock headrest of various manufacturers, makes, and/or models of automobiles or trucks. The headrests are padded and form comfortable supports for the small of the back.

Two holes are drilled near the rear edge 32 of the canoe or boat seat 26 with the distance determined by the selected backrest dimension. Each bracket 16 fastens to the seat 26 via a fastener 24, more particularly a bolt, which is inserted through a bore (not shown) in the L-shaped brace where this bore aligns with the corresponding hole (not shown) in the seat 26. When the fastener 24 is fastened, the L-shaped brace 20 rests upon the top face 30 of the seat 26 near the rear edge 32 and rests against the rear flange 34 perpendicular to the top face 30.

The triangular arm 22 is attached to the top side of the L-shaped brace 20. Another edge of the triangular arm is attached to a support tube such that the support tube may be vertical or slanted slightly away from a vertical manner. The support tube 18 is also attached to the L-shaped brace 20 around the lower ends of both the support tube and the L-shaped brace.

Each support tube 18 is a hollow bore, elongated tube which is fastened in its mid-section to the triangular arm 22 and at its lower end to the L-shaped brace 20. The hollow bore of each support tube 18 allows for one elongated support 14 from the backrest 12 to be inserted into and telescoped within the bore (as shown by the dotted figure in FIG. 1). This telescoping action allows the backrest 12 to be situated in the optimal position for the user. Each support tube 18 has an adjustment means, more particularly a set screw 36 threaded through the wall of the tube, for securing the elongate supports 14 relative to the tubes, thereby allowing adjustment and fastening as needed.

The adjustable canoe or boat seat backrest and frame is easily assembled, connected and used. Two holes or bores are drilled through the canoe or boat seat 26 near the rear edge 32. Each bracket 16 with its L-shaped brace is positioned on the top face 30 and rear edge 32 of the canoe or boat seat with the bore in the L-shaped brace 20 aligning with the corresponding bore or hole in the canoe or boat seat. The fastener 24 then connects each bracket 16 to the canoe or boat seat 26. An automobile headrest is inserted into the support tubes 18 with one elongated support from the backrest in each support tube. When the backrest is properly positioned, the adjustment fastener which is set screw 36 is then tightened and secured.

A reinforcement plate or bar 38 may be attached underneath the canoe or boat seat to add reinforcement as shown in FIG. 1. There is a bore or hole in the bar 38 through which the bolt that connects the bracket to the boat seat is advanced to connect the bar 38. The bar 38 extends beneath the seat forward the front flange 40. The bar 38 on each bracket distributes the bending moment loads at the fastener over its length, thereby decreasing concentrated loads at or near the rear flange.

Figure 3:
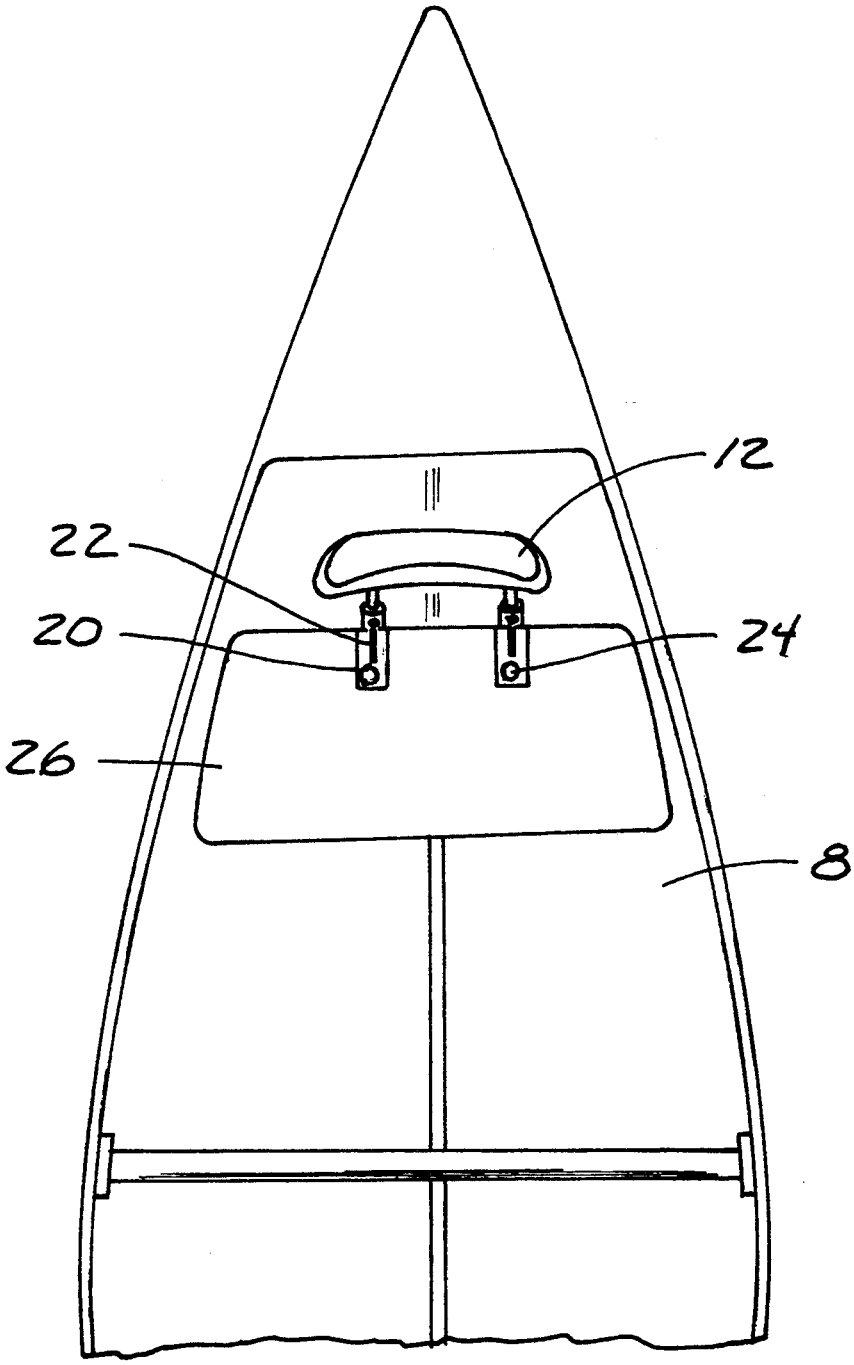
FIG. 3 is a top view of FIG. 1.

FIG. 3 shows the positioning of the L-shaped braces as fastened near the rear edge. The fastener and the L-shaped braces are positioned to allow for adequate seat area for a human to sit comfortably up against the backrest. The fasteners and the L-shaped braces are positioned so near the rear edge that the body when seated on the canoe boat seat with its back up against the backrest does not come into contact with either. This allows the human seated to assume any posture so desired merely by adjusting the backrest to the desired height. The ability to rest the back at a natural position while seated in the canoe or boat reduces or alleviates the backaches and stress that are typical from prolonged sitting, especially without back support.

Although the present invention has been described with reference to preferred embodiments, workers skilled in the art will recognize that changes may be made in form and detail without departing from the spirit and scope of the invention.

What is claimed is:

1. An adjustable boat seat backrest and frame comprising:

a back support member adapted for supporting a human back when a human is seated on a boat seat, the back support member being of padded construction and having a pair of elongated supports extending therefrom;

means for attaching the back support member to the boat seat and positioning the elongated supports in a generally upright position, comprising two support tubes, each having a receptacle for slidably receiving one elongated support of the back support member;

adjusting means for securing the elongated supports to the respective support tube at any selected adjusted position, such that the back support member can be adjusted with respect to the human back by sliding the elongated supports and securing the adjusting means at any selected position;

an L-shaped brace for supporting the back support member against a corresponding edge of the boat seat;

an arm attached to an outer surface of the tube and to a top face of the L-shaped brace; and connecting means to attach the L-shaped brace to the boat seat.

2. The adjustable boat seat backrest and frame of claim 1 wherein the adjusting means is a fastener on each support tube adapted to allow the supporting means to be positioned and then fixed.

3. An adjustable boat seat backrest and frame comprising:

a back support member adapted for supporting a human back when a human is seated on a boat seat, the back support member being an automobile headrest of padded construction and having a pair of elongated supports protruding from the headrest;

means for attaching the back support member to the boat seat and positioning the elongated supports in a generally upright position, comprising two brackets each having a receptacle for slidably receiving one elongated support of the back support member and connecting means for attaching each bracket to the boat seat adjacent one edge of the boat seat;

adjusting means for securing the elongated supports to the respective bracket at any selected adjusted position, such that the back support member can be adjusted with respect to the human back by sliding the elongated supports and securing the adjusting means at any selected position; and reinforcement means for extending under the boat seat comprising a separate bar attached to each bracket through the connecting means.

4. The adjustable boat seat backrest and frame of claim 3 wherein the connecting means which attaches the bars to each bracket consists of a bolt and a nut which clamps the boat seat in between the bracket and the bar.

* * * * *